US011814883B2

(12) United States Patent
Nielsen et al.

(10) Patent No.: US 11,814,883 B2
(45) Date of Patent: Nov. 14, 2023

(54) ANTI-THEFT PASS-THROUGH PAWL FOR AN ACCESS DOOR

(71) Applicant: GM GLOBAL TECHNOLOGY OPERATIONS LLC, Detroit, MI (US)

(72) Inventors: Eric S. Nielsen, Sterling Heights, MI (US); Steve J. Briggs, Harrison Township, MI (US); Robert D. Granny, Rochester Hills, MI (US); Phillip C. Storck, III, Washington Township, MI (US); Gavin J. Brownlie, Jr., Sterling Heights, MI (US); Mark T. McKiernan, Ira Township, MI (US); Jeffrey Kenneth Hansen, Pinckney, MI (US); Yong Sang Cho, Novi, MI (US); Gunghun Jang, New Hudson, MI (US); Suat Kaya, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 405 days.

(21) Appl. No.: 17/202,971

(22) Filed: Mar. 16, 2021

(65) Prior Publication Data

US 2022/0298836 A1 Sep. 22, 2022

(51) Int. Cl.
*E05B 85/06* (2014.01)
*E05B 79/12* (2014.01)
(Continued)

(52) U.S. Cl.
CPC ..... *E05B 85/06* (2013.01); *E05B 77/44* (2013.01); *E05B 79/12* (2013.01); *E05B 17/2092* (2013.01)

(58) Field of Classification Search
CPC ..... E05B 85/06; E05B 77/44; E05B 79/12; E05B 77/34; E05B 77/42; E05B 79/04;
(Continued)

(56) References Cited

U.S. PATENT DOCUMENTS 1,832,362 A * 11/1931 Cullinan ..... B60R 25/042 70/370
2,724,958 A * 11/1955 Psik ..... E05B 1/0038 70/451
(Continued)

FOREIGN PATENT DOCUMENTS

CN 101812948 A 8/2010
CN 102383675 A 3/2012
(Continued)

*Primary Examiner* — Christine M Mills
*Assistant Examiner* — Faria F Ahmad
(74) *Attorney, Agent, or Firm* — Quinn IP Law

(57) ABSTRACT

A door for an entryway includes an exterior-facing surface, an inner structure, and a latch mechanism. The latch mechanism is connected to the inner structure and configured to be fastened or released for controlling access to the entryway. The door also includes a key-cylinder accessible from the exterior-facing surface and configured to selectively lock and unlock the latch mechanism. The door additionally includes a pawl configured to be rotated by the key-cylinder about a pivot axis, connected to the latch mechanism, and defining a pass-through aperture distal from the pivot axis. The door also includes a shield defining a shield attachment aperture and connected to the inner structure. The door further includes a security fastener to fix the shield relative to the key-cylinder at the shield attachment aperture and extending through the pass-through aperture without impeding the pawl's rotation or contacting the pawl as the pawl operates the latch mechanism.

20 Claims, 5 Drawing Sheets

(51) Int. Cl.
*E05B 77/44* (2014.01)
*E05B 17/20* (2006.01)

(58) Field of Classification Search
CPC ..... E05B 79/08; E05B 79/10; E05B 79/22; E05B 85/02; E05B 85/14; E05B 85/16; E05B 85/18; E05B 17/2092; E05B 79/06; E05B 85/10; E05B 1/003; Y10T 292/57
See application file for complete search history.

(56) References Cited

U.S. PATENT DOCUMENTS 3,312,489 A 4/1967 Trudeau
3,868,836 A * 3/1975 La Roche ..... E05B 83/16 70/370
4,212,176 A * 7/1980 Hegedus ..... E05B 83/16 70/417
4,406,557 A * 9/1983 Suzuki ..... F16B 2/22 403/187
4,628,300 A * 12/1986 Amato ..... E05B 77/44 180/289
5,174,619 A * 12/1992 Bender ..... E05B 81/04 70/279.1
5,222,775 A * 6/1993 Kato ..... E05B 81/20 292/216
5,295,374 A * 3/1994 Bender ..... E05B 85/18 292/201
5,499,851 A * 3/1996 Mitchell ..... E05B 79/06 292/DIG. 31
5,725,262 A * 3/1998 Kritzler ..... E05B 83/36 292/DIG. 31
5,852,943 A * 12/1998 Dutka ..... B60S 1/18 292/201
5,987,943 A * 11/1999 Verga ..... E05B 83/16 292/DIG. 31
6,102,453 A * 8/2000 Cetnar ..... E05B 81/06 292/201
6,123,384 A * 9/2000 Eustache ..... B60J 1/1884 15/250.31
6,123,386 A * 9/2000 Montone ..... B60J 5/105 292/336.3
6,141,914 A * 11/2000 Feige ..... E05B 79/06 292/DIG. 31
6,241,294 B1 * 6/2001 Young ..... E05B 77/12 292/336.3
6,264,257 B1 * 7/2001 Meinke ..... E05B 79/20 292/336.3
6,415,636 B1 * 7/2002 Fukumoto ..... E05B 85/16 292/DIG. 31
6,604,393 B2 * 8/2003 Larsen ..... E05B 35/10 70/379 R
6,802,544 B1 * 10/2004 Lane ..... E05B 85/16 292/168
6,843,085 B2 * 1/2005 Dimig ..... E05B 79/20 70/237
6,976,375 B2 * 12/2005 Minix ..... E05B 13/004 292/DIG. 60
7,603,881 B2 * 10/2009 Yukihara ..... E05B 5/00 292/216
8,104,314 B2 * 1/2012 Mueller ..... E05B 9/084 70/451
8,632,116 B2 * 1/2014 Mette ..... E05B 77/44 292/216
8,925,361 B2 * 1/2015 Granny ..... E05B 17/2092 70/451
8,959,964 B2 * 2/2015 Hidaka ..... E05B 85/16 292/DIG. 31
9,062,478 B2 * 6/2015 Bingle ..... E05B 85/107
9,593,514 B2 * 3/2017 Patel ..... E05B 85/10
10,107,016 B2 * 10/2018 Dikici ..... E05B 79/04
11,078,694 B2 * 8/2021 Pettengill ..... E05B 79/10
2003/0010073 A1 * 1/2003 Larsen ..... E05B 35/10 70/210
2004/0206142 A1 * 10/2004 Boesel ..... E05B 77/34 70/417
2011/0187156 A1 * 8/2011 Granny ..... E05B 77/44 70/91
2012/0049578 A1 * 3/2012 Mette ..... E05B 77/44 70/91
2012/0187715 A1 * 7/2012 Arabia, Jr. ..... E05B 77/44 49/506
2015/0345179 A1 * 12/2015 Kushida ..... E05B 27/0007 70/344
2016/0319573 A1 * 11/2016 Da Deppo ..... E05B 79/06
2017/0009498 A1 * 1/2017 Hidaka ..... E05B 77/34
2017/0159332 A1 * 6/2017 Beck ..... E05B 85/16
2019/0010738 A1 * 1/2019 Kobayashi ..... E05B 85/06
2019/0040659 A1 * 2/2019 Sabah ..... G07C 9/00658
2019/0186180 A1 * 6/2019 Iwata ..... E05B 85/06
2019/0345746 A1 * 11/2019 Woo ..... E05B 77/34
2020/0080351 A1 * 3/2020 Guerin ..... E05B 85/06
2020/0263462 A1 * 8/2020 Hirozawa ..... E05B 79/20
2021/0324663 A1 * 10/2021 Cho ..... E05B 85/16
2021/0355721 A1 * 11/2021 Ge ..... E05B 77/34
2022/0372801 A1 * 11/2022 Kaya ..... E05B 81/76

FOREIGN PATENT DOCUMENTS

DE 102016208637 A1 11/2016
EP 2184427 A2 * 5/2010 ..... E05B 17/0041
EP 3147436 A1 * 3/2017 ..... E05B 77/32
GB 9108447 12/1995
GB 2465864 A * 6/2010 ..... E05B 17/0058
JP 2011140803 A 7/2011
WO WO-2019224371 A1 * 11/2019 ..... B60Q 1/2669

* cited by examiner

ANTI-THEFT PASS-THROUGH PAWL FOR AN ACCESS DOOR

INTRODUCTION

The present disclosure relates to a pawl with a pass-through for an anti-theft device in an access door.

Doors are typically used to control access into enclosed structures. A typical motor vehicle has at least one access door. Such a door typically has a latch mechanism for maintaining the door in a locked state until vehicle access into or egress is required. The latch mechanism is typically actuated by an outside door handle to gain access to the interior of the vehicle.

Vehicles may sometimes be subjected to unauthorized entry and theft. To prevent such unauthorized entry while permitting authorized access, on at least some of the vehicle doors the latch mechanism is provided with an externally actuated lock having a key-lock cylinder. Attempts to gain unauthorized entry into the vehicle may include triggering the door latch mechanism by forcibly manipulating and even extracting the key-lock cylinder from the door.

SUMMARY

A door for an entryway includes an exterior-facing surface, an inner structure, and a latch mechanism. The latch mechanism is connected to the inner structure, configured to be fastened, such that the door maintains closure of the entryway, and capable of being released, such that the door opens the entryway. The door also includes a key-cylinder accessible from the exterior-facing surface and configured to selectively lock and unlock the latch mechanism. The door additionally includes a pawl fixed to and configured to be rotated by the key-cylinder about the pivot axis, operatively connected to the latch mechanism, and defining a pass-through aperture spaced apart from the pivot axis. The door also includes a shield defining a shield attachment aperture and connected to the inner structure. The door further includes a security fastener configured to fix the shield relative to the key-cylinder at the shield attachment aperture. The security fastener is also configured to extend through the pass-through aperture without impeding rotation of the pawl or contacting the pawl as the pawl operates the latch mechanism.

The security fastener may be configured to transfer the force to the shield during manipulation and limit the key-cylinder extraction when the key-cylinder is forcibly manipulated from the exterior-facing surface.

The door may also include a bracket connected to the inner structure. In such an embodiment, the key-cylinder may includes a housing mounted to the bracket, and the housing may include a boss spaced apart from the pivot axis and configured to accept the security fastener.

The security fastener may be arranged at an angle greater than zero and smaller than 90 degrees relative to the exterior-facing surface.

The key-cylinder may be arranged orthogonal to the exterior-facing surface.

The key-cylinder may be arranged at an angle greater than zero and smaller than 90 degrees relative to the exterior-facing surface.

The door may also include a rod. In such an embodiment, the pawl may include a rod aperture and the pawl may be connected to the latch mechanism via the rod at the rod aperture. Furthermore, in such an embodiment the shield may be configured to prevent access to the rod when the key-cylinder is forcibly manipulated from the exterior-facing surface.

The pawl may be defined by a profile bend arranged between the key-cylinder and the pass-through aperture. In such an embodiment, the profile bend may position the pass-through aperture in a plane perpendicular to the security fastener.

The pass-through aperture may have an oblong shape.

The shield may be formed from a plastic material.

The door may further include a door-release handle arranged on the exterior-facing surface. In such an embodiment, the bracket may be configured to support the door-release handle, the key-cylinder may be housed in the door-release handle, and the key-cylinder may be configured to be activated by a key.

A vehicle having such a door is also disclosed.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
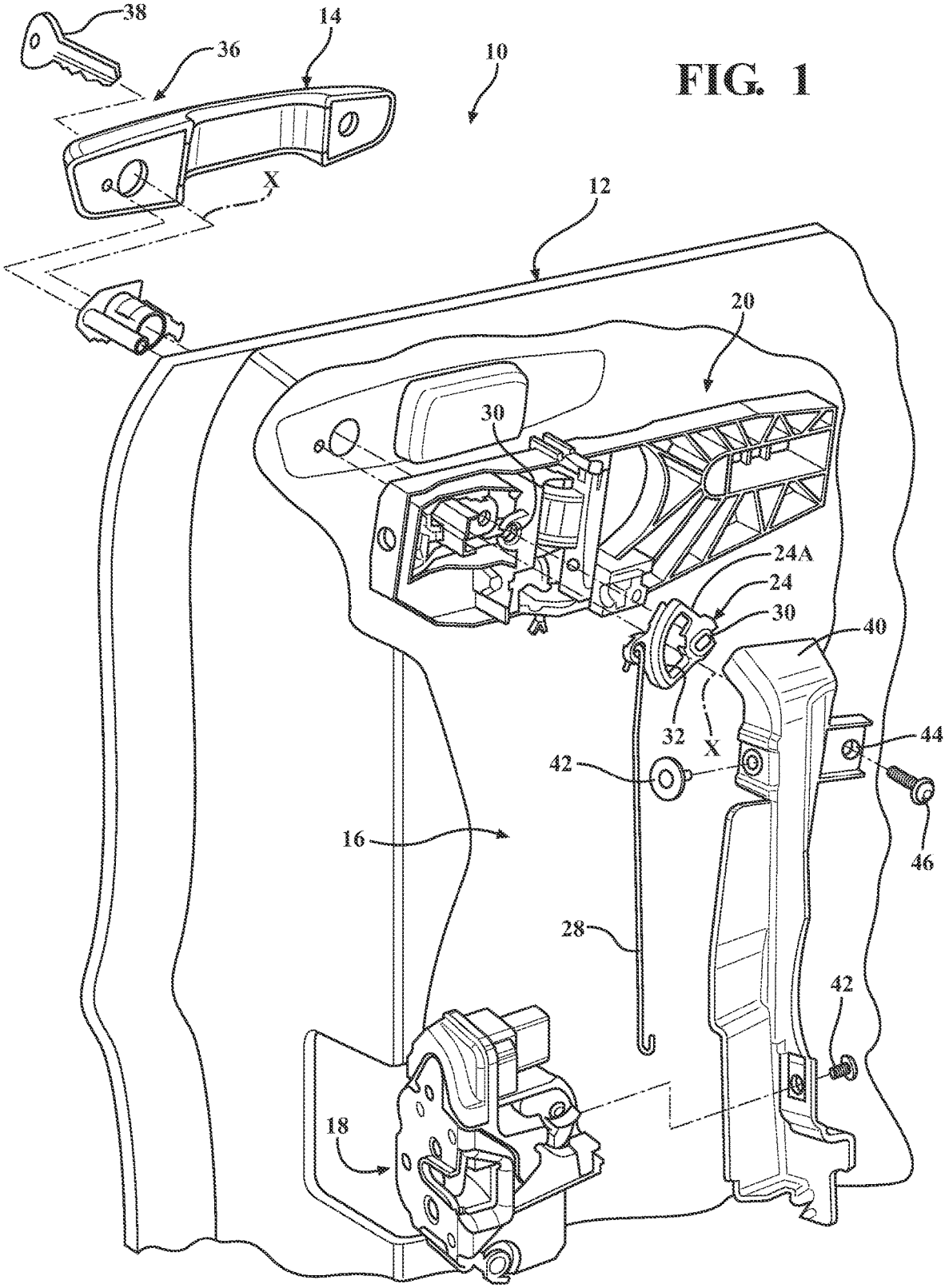
FIG. 1 is a schematic perspective exploded view of a portion of a vehicle door illustrating a pass-through pawl and a security fastener, according to the disclosure.

Referring to the drawings, wherein like reference numbers refer to like components, FIG. 1 shows an exploded view of a vehicle door 10. The door 10 includes an exterior-facing surface 12. An exterior door-release handle 14 is arranged, e.g., mounted, on the exterior-facing surface 12. The door 10 also includes an inner structure 16. The inner structure 16 may have a unitary configuration, or a combination of interconnected brackets and/or mounting members that may be formed from any suitable materials such as steel or aluminum. The inner structure 16 is configured to support, among other items, exterior surface 12, a latch mechanism 18, and various wiring and other door hardware, such as for electrical locking, as known by those skilled in the art.

The latch mechanism 18 is configured to be released via exterior door-release handle 14, as well as via an interior door-release handle (not shown). The latch mechanism 18 is typically connected to the inner structure 16 via suitable fasteners (not shown), and is configured to be fastened, such that door 10 maintains closure of an entryway into the vehicle. The latch mechanism 18 is also capable of being released by the door-release handle 14 to permit the door 10 to open the entryway. Also connected to the inner structure 16 is a bracket 20. The bracket 20 is arranged substantially parallel to the exterior-facing surface 12 (shown in FIG. 2). The bracket 20 is configured to support the door handle 14, is attached to the exterior-facing surface 12 through the use of appropriate fasteners, such as screws 22, and extends through aperture(s) in the door toward the inner structure 16, as shown in FIG. 2.

As shown in FIGS. 1-4, a pawl 24 is rotatably mounted relative to the bracket 20. The pawl 24 may be manufactured from a suitable rigid material, such as steel or engineered plastic. As shown, the pawl 24 may be operatively connected or linked to the latch mechanism 18 via a rod 28 for selectively locking and unlocking a latch 18A. The pawl 24 is shown as having an actuating arm 24A defining a pivot aperture 30 disposed on a pivot axis X. The actuating arm 24A also defines a clearance or pass-through aperture 32, shown as having an oblong shape, spaced apart, i.e., distal, from the pivot axis X. The actuating arm 24A further defines a rod aperture 34. As may be seen in FIGS. 2-4, the pass-through aperture 32 is arranged between the pivot aperture 30 and the rod aperture 34. The rod 28 is connected to the actuating arm 24A at the rod aperture 34, i.e., away from the pivot axis X, such that when the pawl 24 is turned or rotated about the pivot axis, the rod is translated with respect to the latch 18A to selectively lock and unlock latch mechanism 18.

Figure 3:
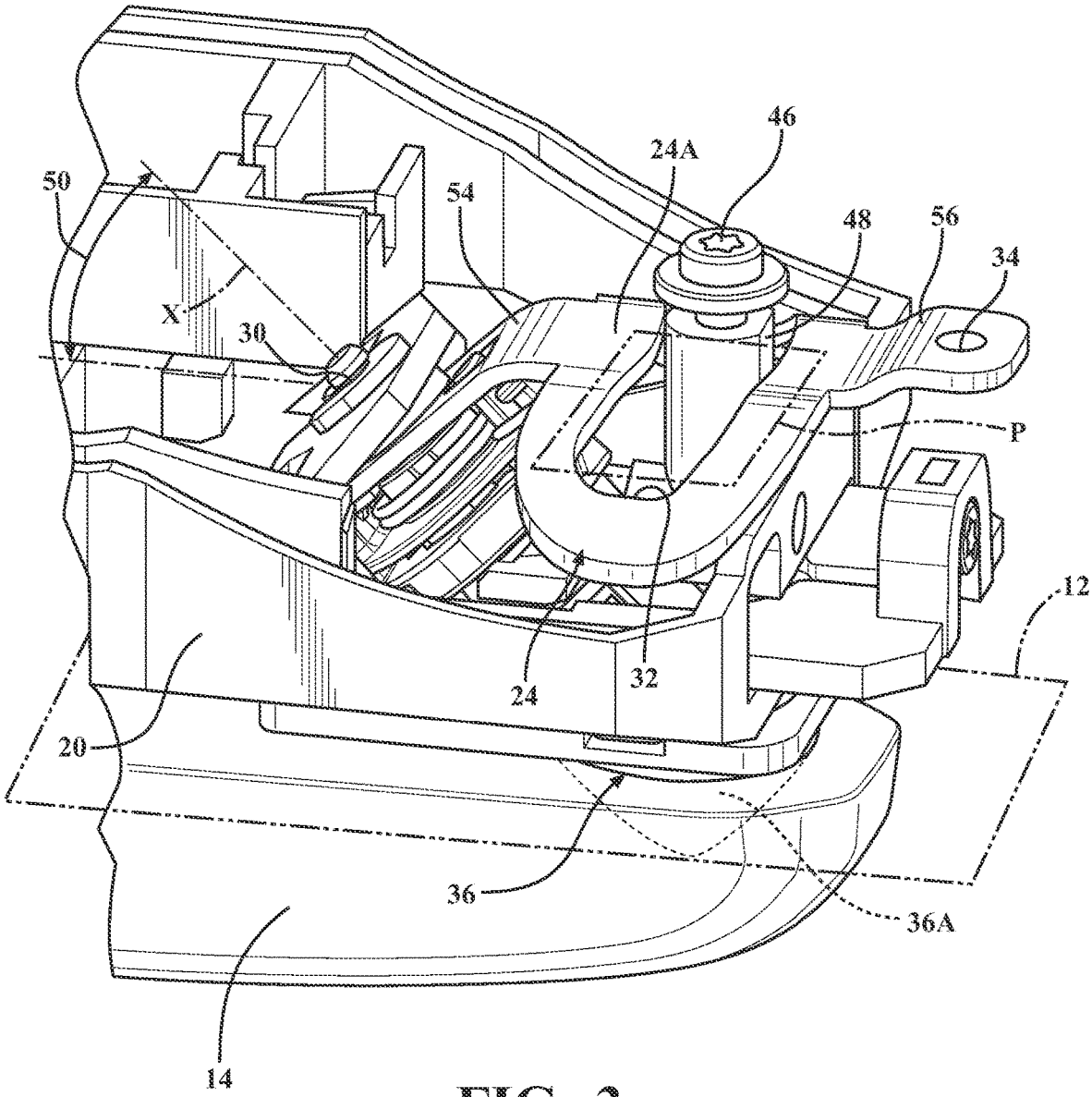
FIG. 3 is schematic perspective partial view of one embodiment of the assembled vehicle door shown in FIG. 1, having the security fastener extend through pass-through pawl during normal operation, according to the disclosure.
Figure 4:
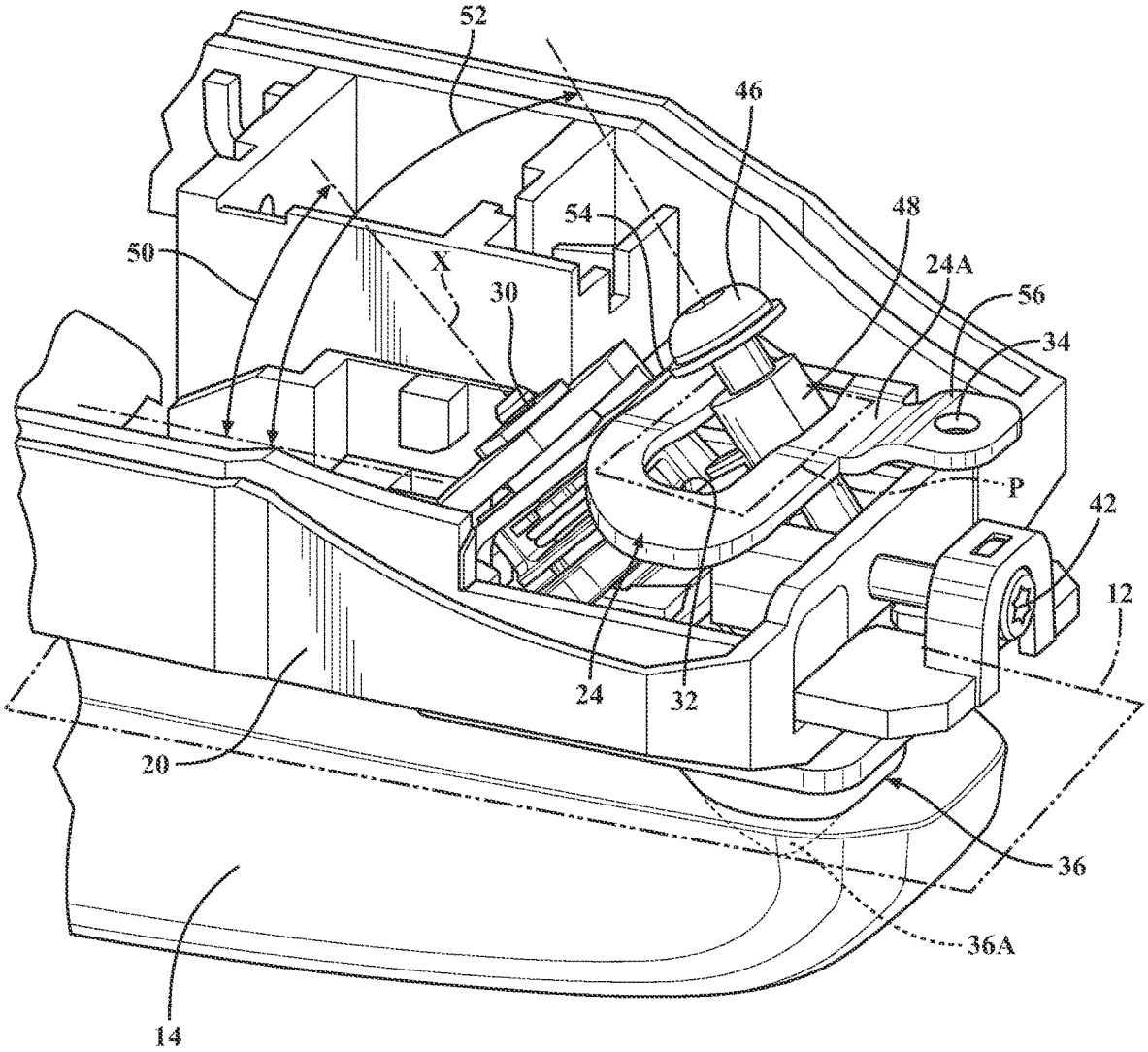
FIG. 4 is schematic perspective partial view of another embodiment of the assembled vehicle door shown in FIG. 1, having the security fastener extend through pass-through pawl during normal operation, according to the disclosure.

A key-cylinder 36, a.k.a., key-lock cylinder, is located on the door 10, such that the key-cylinder is accessible from the exterior-facing surface 12. As shown in FIGS. 2-4, the key-cylinder 36 is housed in the exterior door-release handle 14. The key-cylinder 36 may be accessed either from the external surface of the handle or upon pulling or lifting the handle away from the exterior-facing surface 12. The actuating arm 24A is fixed to the key-cylinder 36 at the pivot aperture 30, for example via a suitable fastener, such as a keyway, a screw, and/or a clip. The key-cylinder 36 is thus configured to rotate the actuating arm 24A about the pivot axis X to selectively lock and unlock the latch mechanism 18. As the key-cylinder 36 rotates the pawl 24, the pass-through aperture 32 swings with the actuating arm 24A about the pivot axis X. The key-cylinder 36 is generally configured to be activated, i.e., turned to lock or unlock the latch mechanism 18, by a key 38 specifically adapted for the particular key-cylinder, for example, cut to match the cylinder's combination of pins, to permit entry into the vehicle. The key-cylinder 36 is typically designed to be tamper-proof, i.e., resistant to being jimmied open and turned to unlock the latch 18 without a proper key 38.

Figure 2:
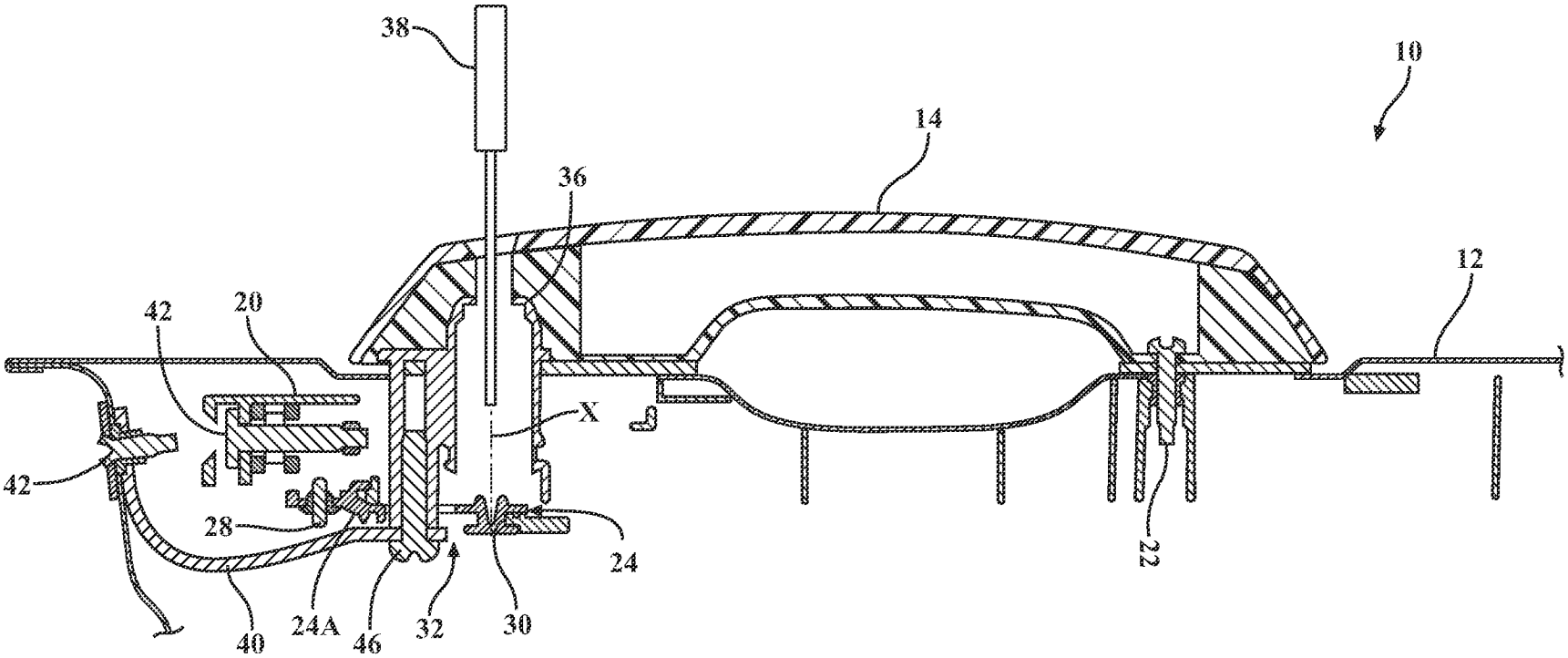
FIG. 2 is schematic cut-away view of the assembled vehicle door shown in FIG. 1, having the security fastener extend through pass-through pawl during normal operation, according to one embodiment of the disclosure.

A shield 40 is connected to the inner structure 16, such that at least part of the inner structure 16 is disposed between the shield and key-cylinder 36 (as shown in FIGS. 1 and 2). The shield 40 is configured to restrict manipulation of the key-cylinder 36 and unauthorized opening of the door 10. The shield 40 may be formed from a plastic or a metal material having suitable rigidity and toughness for resistance to penetration of the door structure through to the interior of the vehicle in case of forced manipulation and extraction of key-cylinder 36. The shield 40 may be connected to the inner structure 16 by fasteners 42. Similar fasteners 42 may be used to fix the key-cylinder 36 to the bracket 20 (shown in FIG. 2). The shield 40 also defines an upper shield attachment aperture 44 configured to accept a security fastener 46. The security fastener 46, such as a threaded bolt or screw, is employed to fix the shield 40 relative to the key-cylinder 36 at the upper shield attachment aperture 44.

The key-cylinder 36 includes a housing 36A mounted to the bracket 20. The housing 36A includes a boss 48 spaced apart from the pivot axis X. The boss 48 is configured to accept the security fastener 46, such that the subject fastener is threadably engaged with the boss and thereby becomes fixed relative to the bracket 20. When the shield 40 is connected to the inner structure 16, the upper shield attachment aperture 44 becomes substantially centered relatively to a threaded hole in the boss 48, as permitted by design and manufacturing tolerances of the shield. The security fastener 46 is specifically arranged to extend through the pass-through aperture 32 without impeding rotation of the pawl 24 or contacting the actuating arm 24A of the pawl 24 as the pawl operates the latch mechanism 18. Such a pass-through arrangement of the security fastener 46 with respect to the pawl 24 permits more compact packaging of the bracket 20 and the door handle 14.

Figure 5:
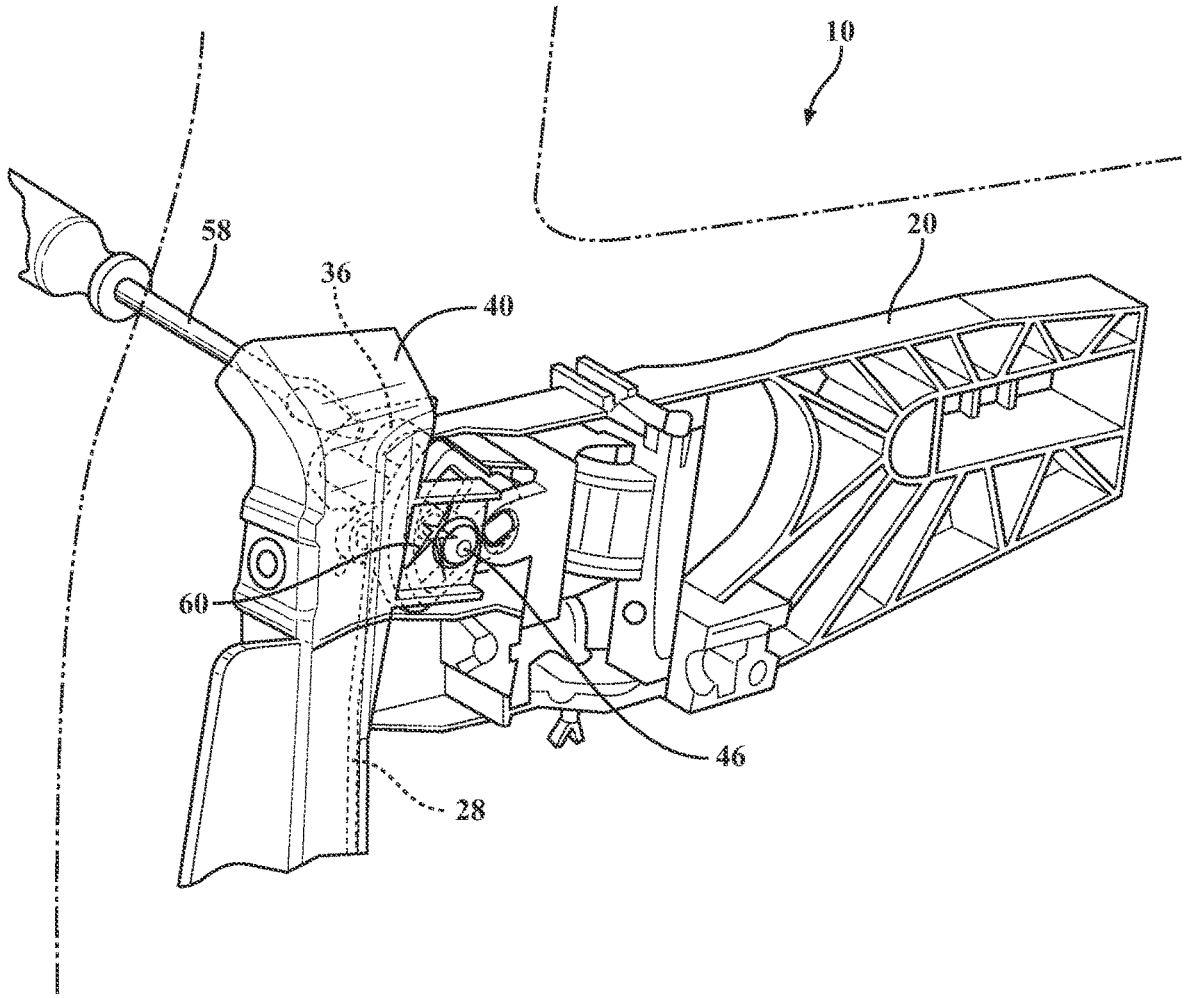
FIG. 5 is a schematic close-up perspective view of the portion of the vehicle door shown in FIG. 1, illustrating a forcibly manipulated key-cylinder resulting in the security fastener contacting the pass-through pawl and a limiting/preventing an extraction of the key-cylinder.

In the event of misalignment between the security fastener 46 (when threaded into the boss 48) and the pawl 24, the subject fastener is configured to generate interference with the pawl and restrict lateral movement of the pawl 24 relative to the bracket. In turn, in the event of forcible manipulation of the key-cylinder 36, such restriction of lateral movement of the pawl limits extraction of the key-cylinder 36 and/or prevent unauthorized vehicle entry. Specifically, as shown in FIG. 5, the shield 40 may be configured to prevent access to the rod 28 when the key-cylinder 36 is forcibly manipulated from outside the vehicle, i.e., from the exterior-facing surface 12. Also, when the key-cylinder 36 is forcibly manipulated from outside the vehicle, the security fastener 46 may transfer the manipulation force to the shield 40, and thereby limit extraction of the key-cylinder from the door 10. Furthermore, when the key-cylinder 36 is forcibly manipulated from outside the vehicle, the security fastener 46 may contact the pawl 24 from inside the pass-through aperture 32 and limit activation of the rod 28 via the pawl 24. Such contact between the security fastener 46 and the pawl 24 may be configured to detach the pawl from the key-cylinder 36, thus rendering the door inaccessible by normal operation via the exterior door-release handle 14.

With resumed reference to FIG. 2, the key-cylinder 36 may be arranged orthogonal to the exterior-facing surface 12. Alternatively, as shown in FIGS. 3-4, the key-cylinder 36 may be arranged at an angle 50 greater than zero but smaller than 90 degrees relative to the exterior-facing surface 12. The angle 50 may be defined as general inclination of the key-cylinder 36 relative to the bracket 20 or the angle between axis X and the exterior-facing surface 12. The angle 50 may be established based on design of the vehicle door 10 and packaging requirements of the exterior door-release handle 14. As shown in FIG. 4, the security fastener 46 as well as the boss 48 may be arranged at an angle 52 relative to the exterior-facing surface 12. The angle 52 may be greater than zero but smaller than 90 degrees. The angle 52 may be generally determined by the shape and position of the shield 40 relative to the exterior-facing surface 12. For example in the embodiment of FIG. 4, the angle 52 may be between 30 and 60 degrees relative to the exterior-facing surface 12.

As shown in FIGS. 3-4, the pawl's actuating arm 24A may be defined by a first profile bend 54. The first profile bend 54 may be arranged between the key-cylinder 36 and the pass-through aperture 32. The first profile bend 54 may be configured to position the pass-through aperture 32 in a plane P substantially parallel to exterior-facing surface 12 and perpendicular to the security fastener 46. As noted above, the pass-through aperture 32 may have an oblong and/or curved shape. The oblong/curved shape of the pass-through aperture 32 may be defined to generally track the path transcribed by the security fastener 46 relative to the actuating arm 24A during rotation of the pawl 24, such as to not impede movement of the pawl, yet retain requisite amount of material and strength in the actuating arm. As may be seen FIGS. 3-4, the pawl's actuating arm 24A may be additionally defined by a second profile bend 56. The second profile bend 56 may be arranged between the pass-through aperture 32 and the rod aperture 34, to thereby advantageously position an attachment point for the rod 18 and facilitate packaging of the pawl 24 and the rod within the door 10.

Although the security fastener 46 does not restrict normal operation of the key-cylinder 36, the subject security fastener does operate to counteract forcible manipulation of the key-cylinder with the intent to gain unauthorized entry into the vehicle. In such a situation, it may be attempted to insert an implement, such as a screwdriver 58 (shown in FIG. 5), into key-cylinder 36 to exert a force and shift the entire key-cylinder in order to displace the rod 28 and unlock the latch mechanism 18. During such forcible manipulation, the entire exterior-facing surface 12 may be flexed in an attempt to trigger the latch mechanism 18. Upon such manipulation, movement of the security fastener 46 will be opposed by the shield 40, however, the security fastener and/or the boss 48 may still come into contact 60 with the actuating arm 24A from inside the pass-through aperture 32, thus restricting movement of key-cylinder 36 independent of exterior-facing surface 12, and reducing the likelihood of a successful forced triggering of latch mechanism 18. The contact 60 between the actuating arm 24A and the security fastener 46 and/or the boss 48 upon the above-described forcible manipulation is depicted in FIG. 5.

During the above-described attempts to gain unauthorized entry into the vehicle via manipulation of the key-cylinder 36 from outside the vehicle, the connection between the security fastener 46 and the shield 40 is intended to limit extraction of the key-cylinder from the door 10. Additionally, if a sufficient amount of force is applied during the above-described attempts to gain unauthorized entry, the resultant pressure generated through the contact 60 between the security fastener 46, and/or the boss 48, and the pawl 24 may separate the pawl from the key-cylinder 36 and the bracket 20. In such a case, the pawl 24 together with the rod 28 will disengage from the key-cylinder 36 and become inoperative. In other words, once the pawl 24 is disconnected from the key-cylinder 36, external manipulation of the key-cylinder will be ineffective in actuating the rod 28 and releasing the latch 18A. The result of such a consequence is that the latch mechanism 18 will remain locked, and unauthorized entry will be thwarted.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

What is claimed is:

1. A door for an entryway, the door comprising:
an exterior-facing surface;
an inner structure;
a latch mechanism connected to the inner structure, configured to be fastened, such that the door maintains closure of the entryway, and capable of being released, such that the door opens the entryway;
a key-cylinder accessible from the exterior-facing surface and configured to selectively lock and unlock the latch mechanism;
a pawl fixed to and configured to be rotated by the key-cylinder about a pivot axis, operatively connected to the latch mechanism, and defining a pass-through aperture spaced apart from the pivot axis;
a shield defining a shield attachment aperture and connected to the inner structure; and
a security fastener configured to fix the shield relative to the key-cylinder at the shield attachment aperture and extend through the pass-through aperture without impeding rotation of the pawl or contacting the pawl as the pawl operates the latch mechanism.

2. The door of claim 1, further comprising a bracket connected to the inner structure; wherein:
the key-cylinder includes a housing mounted to the bracket; and
the housing includes a boss spaced apart from the pivot axis and configured to accept the security fastener.

3. The door of claim 2, wherein the security fastener is arranged at an angle greater than zero and smaller than 90 degrees relative to the exterior-facing surface.

4. The door of claim 2, wherein the key-cylinder is arranged orthogonal to the exterior-facing surface.

5. The door of claim 2, wherein the key-cylinder is arranged at an angle greater than zero and smaller than 90 degrees relative to the exterior-facing surface.

6. The door of claim 1, further comprising a rod, wherein:
the pawl includes a rod aperture; and
the pawl is connected to the latch mechanism via the rod at the rod aperture.

7. The door of claim 6, wherein:
the pawl is defined by a profile bend arranged between the key-cylinder and the pass-through aperture; and
the profile bend is configured to position the pass-through aperture in a plane perpendicular to the security fastener.

8. The door of claim 1, wherein the pass-through aperture has an oblong shape.

9. The door of claim 1, wherein the shield is formed from a plastic material.

10. The door of claim 1, further comprising a door-release handle arranged on the exterior-facing surface, wherein:
the bracket is configured to support the door-release handle;
the key-cylinder is housed in the door-release handle; and
the key-cylinder is configured to be activated by a key.

11. A vehicle comprising:
an entryway;
a door for the entryway, the door having:
an exterior-facing surface;
an inner structure;

a latch mechanism connected to the inner structure, configured to be fastened, such that the door maintains closure of the entryway, and capable of being released, such that the door opens the entryway;

a key-cylinder accessible from the exterior-facing surface and configured to selectively lock and unlock the latch mechanism;

a pawl fixed to and configured to be rotated by the key-cylinder about a pivot axis, operatively connected to the latch mechanism, and defining a pass-through aperture spaced apart from the pivot axis;

a shield defining a shield attachment aperture and connected to the inner structure; and a security fastener configured to fix the shield relative to the key-cylinder at the shield attachment aperture and extend through the pass-through aperture without impeding rotation of the pawl or contacting the pawl as the pawl operates the latch mechanism.

12. The vehicle of claim 11, wherein:

the door additionally includes a bracket connected to the inner structure;

the key-cylinder includes a housing mounted to the bracket; and the housing includes a boss spaced apart from the pivot axis and configured to accept the security fastener.

13. The vehicle of claim 12, wherein the security fastener is arranged at an angle greater than zero and smaller than 90 degrees relative to the exterior-facing surface.

14. The vehicle of claim 12, wherein the key-cylinder is arranged orthogonal to the exterior-facing surface.

15. The vehicle of claim 12, wherein the key-cylinder is arranged at an angle greater than zero and smaller than 90 degrees relative to the exterior-facing surface.

16. The vehicle of claim 11, further comprising a rod, wherein:

the pawl includes a rod aperture; and the pawl is connected to the latch mechanism via the rod at the rod aperture.

17. The vehicle of claim 16, wherein:

the pawl is defined by a profile bend arranged between the key-cylinder and the pass-through aperture; and the profile bend is configured to position the pass-through aperture in a plane perpendicular to the security fastener.

18. The vehicle of claim 11, wherein the pass-through aperture has an oblong shape.

19. The vehicle of claim 11, wherein the shield is formed from a plastic material.

20. The vehicle of claim 11, further comprising a door-release handle arranged on the exterior-facing surface, wherein:

the bracket is configured to support the door-release handle;

the key-cylinder is housed in the door-release handle; and the key-cylinder is configured to be activated by a key.

* * * * *